US006222309B1

(12) United States Patent
Taga et al.

(10) Patent No.: US 6,222,309 B1
(45) Date of Patent: Apr. 24, 2001

(54) COLOR CATHODE RAY TUBE WITH SPECIFIC SKIRT PORTION

(75) Inventors: Hiroki Taga; Kazumasa Hirai; Tatsuya Mochizuki, all of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/611,530

(22) Filed: Jul. 6, 2000

Related U.S. Application Data

(63) Continuation of application No. 09/125,281, filed as application No. PCT/JP96/00385 on Feb. 21, 1996.

(51) Int. Cl.[7] ..... H01J 29/07
(52) U.S. Cl. ..... 313/402; 313/407
(58) Field of Search ..... 313/402, 404, 313/407, 408

(56) References Cited

U.S. PATENT DOCUMENTS 4,678,963 7/1987 Fonda .
5,103,132 4/1992 Bolt et al. .

*Primary Examiner*—Vip Patel
(74) *Attorney, Agent, or Firm*—Antonelli, Terry, Stout & Kraus, LLP

(57) ABSTRACT

In order to prevent doming effect in a shadow mask of a color cathode ray tube caused by thermal expansion of the shadow mask structure produced by heating of the shadow mask due to impingement of the electron beam thereon, the shadow mask is provided with a skirt portion along at least one side thereof. The skirt portion includes a long projection portion where the shadow mask is welded to the frame, an adjacent inclined portion which decreases in length in a direction away from the projection portion. Further, a short portion is disposed therebetween the inclined portion. The inclined portion decreases in length linearly or non-linearly.

12 Claims, 5 Drawing Sheets

COLOR CATHODE RAY TUBE WITH SPECIFIC SKIRT PORTION

CROSS REFERENCE TO RELATED APPLICATION

This is a continuation of U.S. application Ser. No. 09/125,281, filed Aug. 14, 1998, which is a 371 of PCT/JP96/00385, filed Feb. 21, 1996 the subject matter of which is incorporated by reference herein.

BACKGROUND OF THE INVENTION

The present invention relates to a color cathode ray tube and more particularly to a color cathode ray tube in which beam landing errors caused by thermal expansion of the shadow mask structure are reduced without reducing the strength of the shadow mask.

A cathode ray tube used for displaying a color image has a glass envelope which includes a panel portion on which a display screen is disposed, a neck portion accommodating an electron gun, and a funnel portion connecting the panel portion and the neck portion. At the funnel portion there is installed a deflection device that scans an electron beam emitted from the electron gun over a phosphor screen formed on the inner surface of the panel portion.

The electron gun accommodated in the neck portion has a variety of electrodes, such as a cathode electrode, a control electrode, a focus electrode and an accelerating electrode. The electron beam emitted from the cathode electrode is modulated by a signal applied to the control electrode and is passed through the focus electrode and the accelerating electrode to be formed into a desired cross-sectional shape and is given a desired energy before impinging on the phosphor screen. The electron beam, on its path from the electron gun to the phosphor screen, is deflected horizontally and vertically by the deflection device installed on the funnel portion to form an image on the phosphor screen (Japanese Patent Laid-Open No. 215640/1984).

When the electron beam emitted from the electron gun is subjected to color selection by a shadow mask disposed inside the panel portion so that its portion corresponds to the color phosphors that are selected, a part of the beam other than that which strikes the phosphor screen impinges on the shadow mask. When the electron beam strikes the shadow mask, a part of the energy of the electron beam is converted into thermal energy, which in turn raises the temperature of the shadow mask causing thermal expansion thereof.

The shadow mask is formed in the shape of a dome curving toward the panel side and is surrounded by a frame along its periphery. Hence, when the shadow mask undergoes thermal expansion, it expands towards the phosphor screen side, and a so-called doming phenomenon occurs.

Common measures against the doming phenomenon include the use of an invar material with a low thermal expansion coefficient for the material of the shadow mask, the use of a bimetal for the spring supports for the shadow mask, and the shortening of the skirt portion of the shadow mask.

When invar material having a low thermal expansion coefficient is used for the material of the shadow mask, the doming of the shadow mask, even with a nearly flat shape, can be prevented because the invar itself has a low thermal expansion characteristic.

The invar material used for the shadow mask with a low thermal expansion coefficient exhibits a strong spring phenomenon and thus, when it is press-formed, spring-back occurs at the skirt portion of the shadow mask, making it difficult to press the skirt portion into a shape corresponding to the design values. Further, the invar material has a high cost, thereby raising overall the cost of the color cathode ray tube.

When a bimetal element made by joining together materials with different thermal coefficients is used for the spring support members which hold the shadow mask structure, the warping of the bimetal material as a result of temperature variation can be utilized to move the shadow mask structure to match the position of the electron beam passing openings with the electron beam passing positions to balance the purity drift and the ambient temperature duff.

The use of a bimetal material for the mask spring support members, however, has a drawback. During the operation of the color cathode ray tube, when the ambient temperature of the shadow mask structure increases, the entire shadow mask structure moves more than required to achieve correct compensation, which in turn causes beam landing errors.

An example of a construction in which the shadow mask has a short skirt portion between the welded fixed portions is found in Japanese Patent Laid-Open No. 22048/1992.

In this shadow mask construction, although the doming characteristic can be improved by making the skirt portion between the welded fixed portions shorter than the welded fixed portions, the narrow skirt width between the welded fixed portions of the shadow mask results in a reduced strength, making the handling of the shadow mask structure during the manufacturing process difficult.

Particularly for shadow masks used in large cathode ray tubes, a sufficiently large strength is required to prevent the shadow mask from being deformed.

Increasing the skirt width for a greater strength reduces the doming reduction effect due to the thermal expansion of the skirt portion. The deformation of the shadow mask structure and the doming phenomenon entails a beam landing shift, deteriorating the color purity.

In addition, a color display tube of the type used in a color monitor is required to have an increased number of horizontal scanning lines compared with the color cathode ray tubes used for color television, which in turn increases the amount of heat produced in the shadow mask and the deflection yoke. The color impurity caused by the doming phenomenon due to heating becomes more serious in this case and produces a major problem in a high definition cathode ray tube that has a shadow mask hole pitch of 0.31 mm or less, which determines the dot pitch of the phosphor screen, or has substantially 1,000 or more horizontal scanning lines.

The present invention is intended to solve the above problem and its objective is to provide a color cathode ray tube that has a shadow mask with a strength sufficient to prevent deformation and with a small strain and that has reduced beam landing errors.

SUMMARY OF THE INVENTION

By shortening only the skirt portion near the position where color impurity due to the doming phenomenon occurs and elongating the other skirt portions during the process of welding the shadow mask to the frame and mounting it to a cathode ray tube, it is possible to provide a color cathode ray tube with a shadow mask that has an increased mechanical strength, is not deformed when subjected to impacts, is easily handled during the manufacture of the cathode ray tube and can prevent color impurity due to thermal expansion of the shadow mask.

DESCRIPTION OF THE PREFERRED EMBODIMENTS

Figure 1:
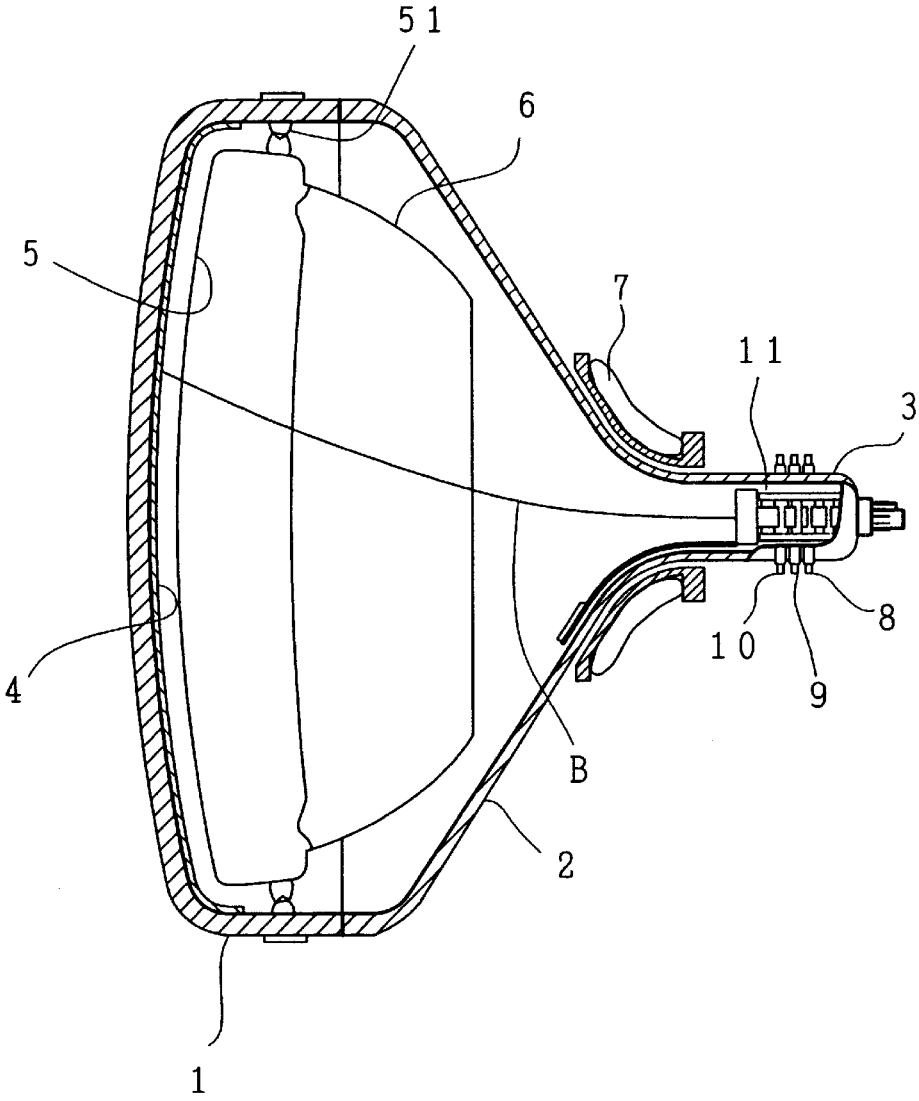
FIG. 1 is a schematic cross section of a cathode ray tube according to this invention.

A color cathode ray tube with a shadow mask structure, in which the skirt portion of the shadow mask is securely welded to the frame, need only have a projecting skirt portion whose welding portion to be welded to the frame has the longest skirt length and, at least in one part of the shadow mask, an inclined skirt portion whose skirt length decreases gradually from the welding portion toward a corner portion of the shadow mask.

Now, embodiments of this invention will be described with reference to the accompanying drawings, in which similar reference numerals represent like parts.

FIG. 1 is a cross section schematically showing the construction of a cathode ray tube according to this invention. The cathode ray tube has a panel portion 1, a funnel portion 2, a neck portion 3, a phosphor screen (display screen 4), a shadow mask structure 5 for color selection, panel pins 51 for supporting the shadow mask structure 5, a magnetic shield 6 to shield a space in the funnel portion from external magnetism, a deflection device (deflection yoke) 7 to scan the electron beam emitted from the electron gun over the phosphor screen formed on the inner surface of the panel portion, a purity adjustment magnet 8, a center beam static convergence adjustment magnet 9, a side beam static convergence adjustment magnet 10, and an electron gun 11, and B denotes an electron beam.

Three electron beams B for red, green and blue colors are deflected horizontally and vertically by the deflection yoke 7 installed at the funnel portion 2 as they travel from the electron gun to the phosphor screen 4. The electron beams B are then color-selected by the shadow mask disposed inside the panel portion so that the beams correspond in position to the intended color phosphors on the screen, and impinge on the corresponding color phosphors to generate the selected colors, forming an image on the panel surface.

Figure 2:
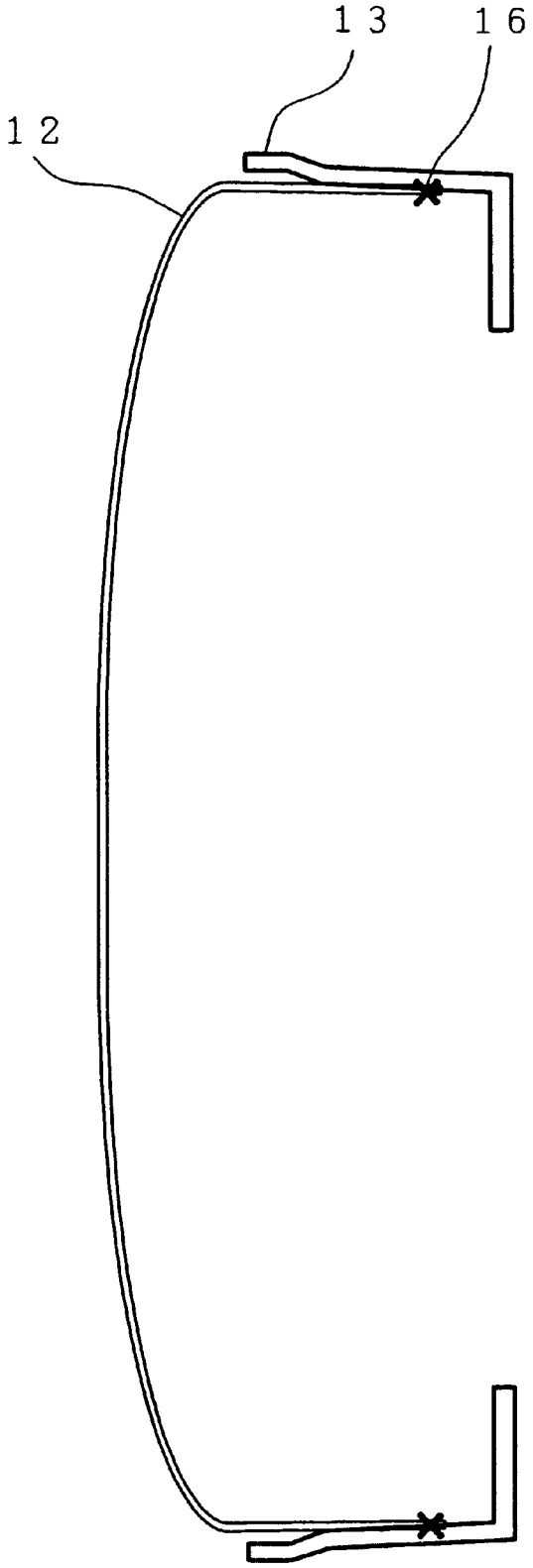
FIG. 2 is a schematic cross section of a shadow mask structure according to this invention.
Figure 3:
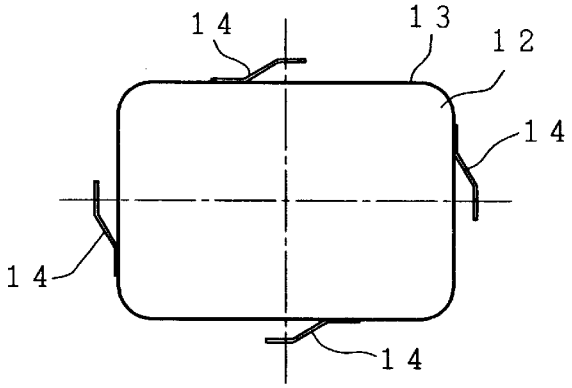
FIG. 3 is a schematic diagram of the shadow mask of this invention, when viewed from the panel surface side.

FIG. 2 is a schematic cross section of the shadow mask structure 5 according to this invention, in which the shadow mask surface having electron beam passing openings faces to the side. FIG. 3 is a schematic view of the shadow mask of this invention, when viewed from the panel portion 1 toward the cathode. The shadow mask structure 5 includes a shadow mask 12 having a plurality of electron beam passing openings for color selection, a frame 13 for holding the shadow mask 12, and mask springs 14 for holding the frame 13 in the panel. The mask springs 14 arranged on the shadow mask structure 5 are joined to the panel pins 51 formed in the panel portion 1, as seen in FIG. 1, to hold the shadow mask structure 5.

Welded portions between the shadow mask 12 and the frame 13 are provided on the skirt portion near the portions where the minor axis passing through the center of the shadow mask 12 intersects the long sides of the shadow mask and where the major axis passing through the center of the shadow mask 12 intersects the short sides of the shadow mask and also on the skirt portion at the corners.

The doming phenomenon is likely to develop at intermediate portions between the minor axis and the short sides of the shadow mask 12, while no doming of a degree causing a problem occurs near the minor axis.

Figure 4:
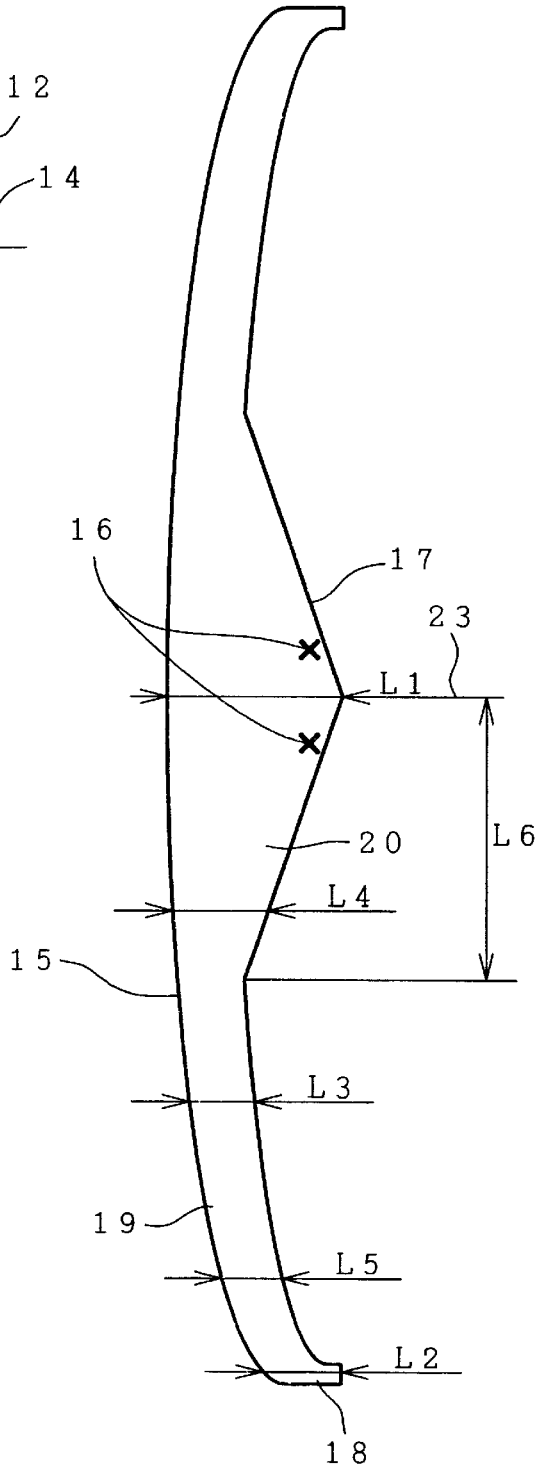
FIG. 4 is a schematic diagram showing a long side of the shadow mask structure of one embodiment of this invention.

FIG. 4 is a schematic diagram of one embodiment of this invention showing a side view of the long side portion of the shadow mask 12, with the shadow mask surface 15 facing to the left.

Reference number 16 represents welding portions between the shadow mask 12 and the frame 13; 17 denotes a projecting portion of the skirt along the long side of the shadow mask 12 for welding that has welding portions 16 (hereinafter referred to as a long side projecting portion); 18 denotes a projecting skirt portion of the corners of the shadow mask for welding that has a welding portion (hereinafter referred to as a corner projecting portion); 19 denotes a short skirt portion situated between the long side projecting portion 17 and the corner projecting portion 18; 20 denotes an inclined skirt portion situated between the long side projecting portion 17 and the corner projecting portion 18 and which is adjacent to the long side projecting portion 17; 23 denotes a center axis of one side of the shadow mask; and L6 is the length from the skirt center axis 23 over which the projection section is provided to the portion where the inclined skirt portion is provided.

Letting L1 represent the skirt length of the longer side projecting portion 17 of the shadow mask 12, L2 the skirt length of the corner projecting portion 18, L3 the skirt length on the long side of the shadow mask at a portion where the doming characteristic of the intermediate portion between the minor axis and the short side is problematic, L4 the skirt length of the inclined skirt portion 20, and L5 the skirt length of an intermediate portion between the corner projecting portion 18 and the position L3, on the long side where the doming characteristic of the intermediate portion between the minor axis and the shorter side is problematic, the following relation holds L1>L4>L2>L5>L3.

That is, the shadow mask 12 has the long side projecting portion 17 where the skirt length of the welding portion between the skirt portion and the frame is the greatest, the inclined skirt portion 20 adjacent to the long side projecting portion 17 and having a skirt length gradually decreasing, and the short skirt portion 19 adjacent to the other end of the inclined skirt portion 20 and having a shorter skirt length than that of the long side projecting portion 17.

The doming phenomenon tends to occur in the intermediate portion between the minor axis passing through the center of the shadow mask 12 and the short sides of the shadow mask 12, while no doming which becomes a problem occurs near the short axis, namely near the long side projecting portion 17 having the welding portions 16. Thus, the short skirt portion 19 is provided at least in an intermediate portion between the long side projecting portion 17 and the corner projecting portion 18 to achieve a doming phenomenon reduction effect.

Further, it is desirable that the short skirt portion 19 having an almost constant skirt length be formed over the portion from the intermediate part between the long side projecting portion 17 and the corner projecting portion 18 to the corner projecting portion 18. It should be noted, that the short skirt portion 19 is not limited to the portion from the intermediate part between the long side projecting portion 17 and the corner projecting portion 18 to the corner portion, but at least the portion where the doming phenomenon occurs needs to have a short skirt portion.

When the inclined skirt portion 20 is so formed as to extend beyond the intermediate point between the long side projecting portion 17 and the corner projecting portion 18, the area of the skirt portion increases, which may enhance the doming phenomenon. Hence, the inclined skirt portion whose skirt length gradually changes needs only to be provided at least at a part of the region from the long side projecting portion 17 to the intermediate point between the long side projecting portion 17 and the corner projecting portion 18.

For example, consider a case where the shadow mask 12 used for a color cathode ray tube with a diagonal screen dimension of 66 cm is made of aluminum killed steel (AK) and has a thickness of 0.25 mm and skirt lengths L1 of 25 mm, L2 of 13 mm, L3 of 10 mm and a distance L6 on the long side of 160 mm. On the two long sides, two points 110 mm from the minor axis were restrained and, with the shadow mask surface 15 facing up, measurements were made of stresses in the shadow mask 12 induced by its own weight. It has been found in this test that the shadow mask with the inclined skirt portion 20 has about 35% less vertical stress and about 96% less tangential stress than a shadow mask without the inclined skirt portion 20.

The maximum beam shift amount was about 60 $\mu$m 3 minutes after the start of operation. In a color cathode ray tube with a conventional shadow mask, i.e., a shadow mask that has no projecting skirt portion, no short skirt portion and no inclined skirt portion, however, the maximum beam shift amount was about 176 $\mu$m 5 minutes after the start of operation. The color cathode ray tube using a shadow mask having a projecting skirt portion, a short skirt portion and an inclined skirt portion exhibits significant improvements over the color cathode ray tube which employs a conventional shadow mask in the amount of shift of the electron beam, thereby providing a reduction in the electron beam shift down to a level that cannot be recognized visually.

The shadow mask without the inclined skirt portion 20 is deformed at a point 100 mm from the minor axis. The provision of the inclined skirt portion 20 can prevent this deformation.

While FIG. 4 shows that the inclined skirt portion extends from the center axis 23 of the skirt toward the short skirt portion 19, with the skirt length decreasing linearly, it is possible to form a Oat portion near the vertex of the projecting portion.

Next the function of the shadow mask will be explained. When the shadow mask 12 performs color selection so that the beams will reach corresponding color dots, the electron beam B striking the shadow mask 12 increases the temperature of the shadow mask 12 causing it to thermally expand.

The electron beam B does not impinge on the skirt portion of the shadow mask 12. Consequently, the heat produced in the shadow mask 12 is transferred to the skirt portion, raising its temperature.

The short skirt portion 19 has its skirt length shorter than the skirt length L1 of the long side projecting portion 17. The short skirt length reduces the volume of the skirt portion and its heat radiation area, making it easier for the temperature of the shadow mask 12 to rise. The thermal expansion of the skirt portion increases to an extent corresponding to this temperature rise.

Hence, the difference in temperature rise between the shadow mask surface 15, the temperature of which is raised by the impingement of the electron beam, and the skirt portion 13 decreases, causing thermal expansion of the whole shadow mask 12.

Figure 5:
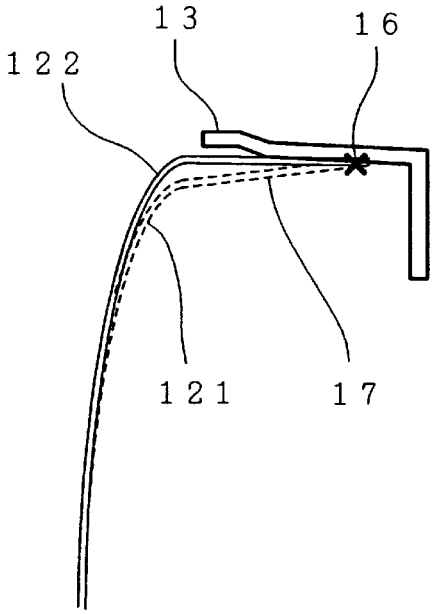
FIG. 5 is a partial schematic cross section of the shadow mask structure of this invention, illustrating how the doming phenomenon is reduced.

FIG. 5 is a schematic view showing a part of the shadow mask 12 of this invention and illustrating the effect of reducing the doming phenomenon. The dotted lines 121 show a shadow mask before being thermally expanded and the solid lines 122 represent the shadow mask after thermal expansion.

The long side projecting portion 17 has the welding portions 16 where the shadow mask is secured to the frame 13.

The frame 13 has a greater heat capacity than that of the shadow mask 12, and hence it takes longer for the frame to thermally expand. The shadow mask 12, on the other hand, is thin and has a good heat conductivity and, therefore, only the shadow mask 12 undergoes thermal expansion. In the shadow mask, the skirt length is long only at the long side projecting portion 17 where the welding portions 16 are provided, and the long side projecting portion 17 is made mechanically weak by the half-etch. The welding portions 16 are located at the lower part of the projecting portion, so the shadow mask 121 can have a large margin in the direction of the frame outer diameter in which the external size of the shadow mask 121 increases. Therefore, the shadow mask 121 can thermally expand as shown by lines 122.

That is, because the margin in the frame outer diameter direction is large, the thermal expansion of the effective surface portion of the shadow mask 12 is not absorbed by the doming, but the component of the thermal expansion directly absorbed by the expansion of the external dimensions increases, thereby reducing the amount of doming.

Further, because the skirt portion, other than the welded portions, is short, the thermal expansion toward the phosphor screen is small, reducing the doming.

As the short skirt portion increases, the strength of the shadow mask against stress becomes weak. A sharp change in the skirt length may also cause strain when the shadow mask is subjected to stress. Because the skirt length of the inclined skirt portion is changed gradually to the skirt length of the short skirt portion, the strength of the skirt portion changes gradually, thus causing no stress concentration.

Figure 6:
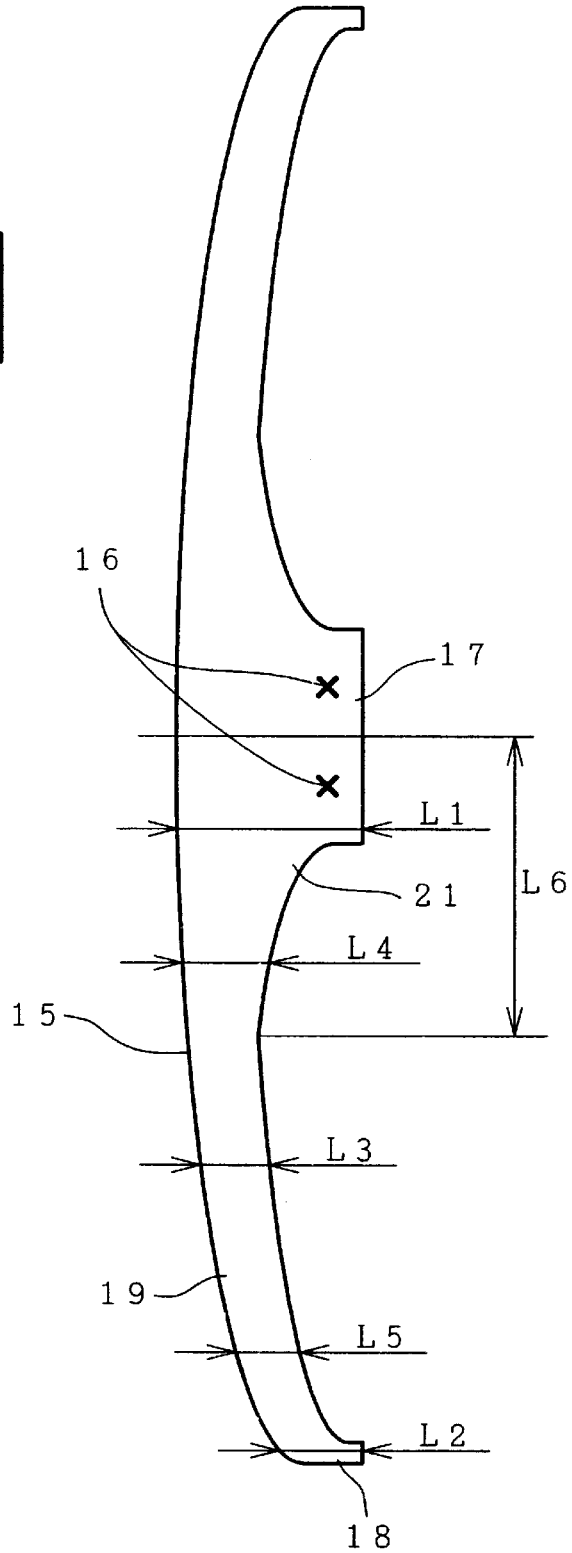
FIG. 6 is a schematic diagram showing a long side of the shadow mask structure of another embodiment of this invention.

FIG. 6 shows another embodiment of this invention, in which similar parts to those of FIG. 4 are identified by like reference numerals.

The shadow mask 12 has a short skirt portion 19 and a long side projecting portion 17, and an inclined skirt portion adjacent to the long side projecting portion 17 has a curved portion 21 where its skirt length decreases in a curve. With this configuration, the area of the skirt becomes small, which in turn reduces the heat radiation and minimizes the landing errors resulting from the doming phenomenon. At the same time, with regard to the strength of the shadow mask, since the skirt length changes gradually from the minor axis toward the intermediate portion, the stress concentration can be dispersed, preventing the distortion of the shadow mask.

For example, let us consider a case in which the shadow mask used for a color cathode ray tube with a diagonal screen dimension of 66 cm is made of an aluminum killed steel (AK), and has a thickness of 0.25 mm~and skirt lengths L1 of 25 mm, L2 of 13 mm, L3 of 10 mm and a distance L6 on the long side of 160 mm. On the two long sides, two points 110 mm from the minor axis were restrained and, with the shadow mask surface 15 facing up, measurements were made of stress in the shadow mask 12 induced by its own weight. The result of this test showed that the shadow mask with the inclined skirt portion 21 having a curved portion has about 24% less vertical stress and about 70% less tangential stress than the shadow mask without the inclined skirt portion 21 does.

The maximum beam shift amount when this shadow mask was used was about 58 μm 3 minutes after the start of operation. In a color cathode ray tube with a conventional shadow mask, i.e., a shadow mask that does not have a projecting skirt portion, a short skirt portion and an inclined skirt portion, however, the maximum beam shift amount was about 176 μm 5 minutes after the start of operation. The color cathode ray tube using a shadow mask having the projecting skirt portion, the short skirt portion and the inclined skirt portion is significantly improved over the color cathode ray tube using the conventional shadow mask in the amount of shift of the electron beam, providing a reduction in the electron beam shift down to a level that cannot be recognized visually.

The shadow mask without the inclined skirt portion 21 is deformed at a point 100 mm from the minor axis. The provision of the inclined skirt portion 21 can prevent this deformation.

The inclined portion situated between the projecting skirt portion and the short skirt portion may have both a portion whose skirt length changes gradually in a curved line and a portion whose skirt length changes gradually linearly. Such an inclined portion produces a similar effect to that described above.

Figure 7:
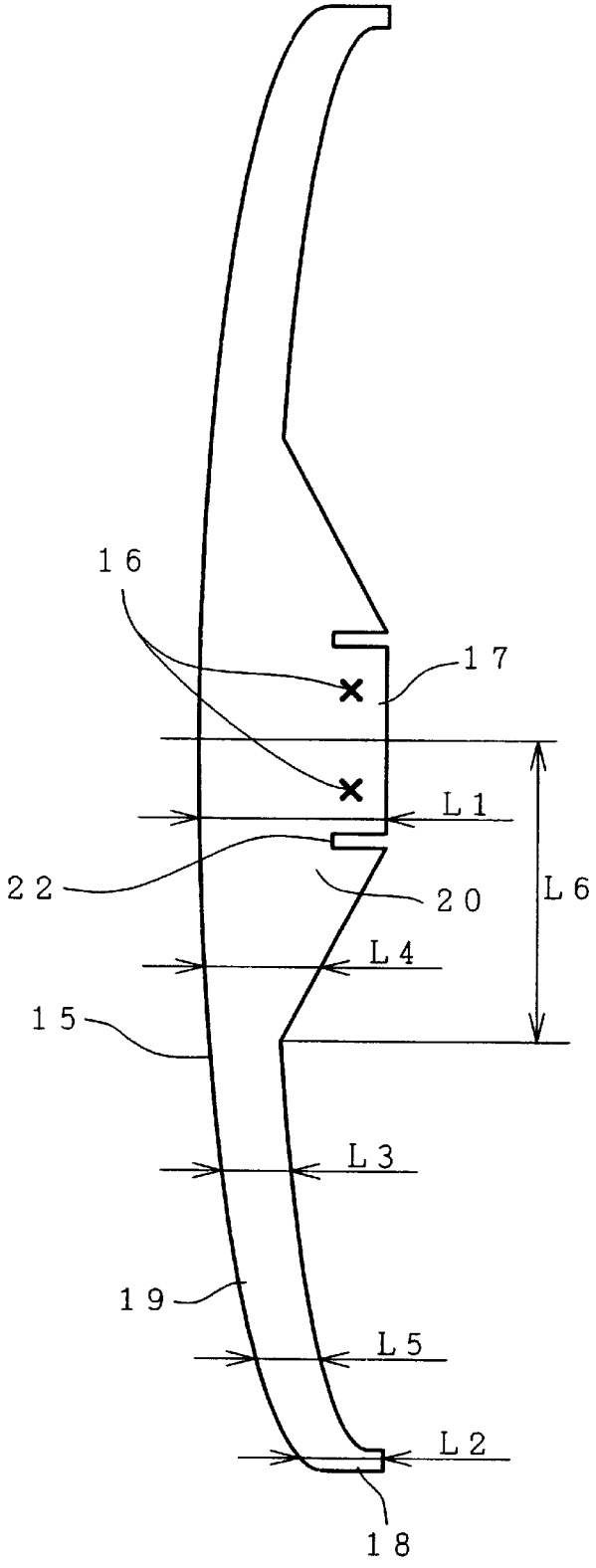
FIG. 7 is a schematic diagram showing a long side of the shadow mask structure of still another embodiment of this invention.

FIG. 7 shows another embodiment of this invention, in which parts similar to those of FIG. 4 are assigned like reference numerals.

The shadow mask 12 has a short skirt portion 19, a long side projecting portion 17 and an inclined skirt portion 20 adjacent to the long side projecting portion 17. Between the long side projecting portion 17 and the inclined skirt portion 20 there is a notch 22. With this configuration, the area of the skirt becomes small, which in turn reduces the heat radiation and minimizes the landing errors resulting from the doming phenomenon. At the same time, with regard to the strength of the shadow mask, since the skirt length changes gradually from the minor axis toward the intermediate portion, the stress concentration can be dispersed, preventing the distortion of the shadow mask.

For example, let us consider a case in which the shadow mask used in a color cathode ray tube with a diagonal screen dimension of 66 cm is made of an aluminum killed steel (AK), and has a thickness of 0.25 mm and sk~rt lengths L1 of 25 mm, L2 of 13 mm, L3 of 10 mm and a distance L6 on the longer side of 160 mm. On the two long sides, two points 110 mm from the minor axis are restrained and, with the shadow mask surface 15 facing up, measurements were made of stress in the shadow mask 12 induced by its own weight. The result of this test showed that the shadow mask with the inclined skirt portion 20 having a notch 22 has about 37% less vertical stress and about 94% less tangential stress than the shadow mask without the inclined skirt portion 20 does.

The maximum beam shift amount when this shadow mask was used was about 62 μm 3 minutes after the start of operation. In a color cathode ray tube with a conventional shadow mask, i.e., a shadow mask that does not have a projecting skirt portion, a short skirt portion and an inclined skirt portion, however, the maximum beam shift amount was about 176 μm 5 minutes after the start of operation. The color cathode ray tube using a shadow mask having the projecting skirt portion, the short skirt portion and the inclined skirt portion is significantly improved over the color cathode ray tube using a conventional shadow mask in the amount of shift of the electron beam, thereby providing a reduction in the electron beam shift down to a level that cannot be recognized visually.

The shadow mask without the inclined skirt portion 20 having a notch 20 is deformed at a point 100 mm from the minor axis. The provision of the inclined skirt portion 20 can prevent this deformation.

While the above description concerns the long side skirt portion, it is also possible to form a short side projecting portion, a short skirt portion and an inclined skirt portion at the short side skirt portion, not shown, of the shadow mask 12 in a manner similar to the long side skirt portion.

Although there has been described a case where the welding portions are located near the skirt center axis, this invention is not limited to this configuration and any shadow mask may be used as long as the shadow mask has a projecting portion which serves as the welding portion between the shadow mask and the frame, an inclined skirt portion which is adjacent to the projecting portion and whose skirt length gradually decreases, and a short skirt portion which is adjacent to the other end of the inclined skirt portion and whose skirt length is shorter than that of the projecting skirt portion.

Forming the inclined skirt portion in the range from the projecting portion to the short skirt portion increases the strength of the shadow mask against the stress applied thereto. This configuration reduces the area of the skirt portion and therefore the heat radiation. At the same time, with regard to strength, since the skirt length changes gradually from the minor axis toward the intermediate portion, the stress concentration can be dispersed, preventing the distortion of the shadow mask.

Further, this configuration can also prevent the doming phenomenon of the shadow mask and reduce the electron beam landing errors caused by the doming phenomenon down to a level that cannot be recognized visually. It is also possible to provide a shadow mask with a strength large enough to avoid any problem that may occur during the manufacturing processes of the cathode ray tube.

As described above, the cathode ray tube of this invention is suited for use as a color cathode ray tube with a shadow mask in which thermal expansion of the shadow mask caused by electron beams impinging on the shadow mask may result in color impurity.

What is claimed is:

1. A color cathode ray tube including a panel portion, a neck portion, a funnel portion connecting said panel portion and said neck portion, a shadow mask structure having a skirt portion of the shadow mask welded to a frame, said shadow mask having at least one of a longer side skirt portion and a shorter side skirt portion, and an electron gun housed in the neck portion which emits a plurality of electron beams, wherein said shadow mask includes a projecting skirt portion of the skirt portion having a welding portion which welds the shadow mask to the frame, the welding portion being located at a lower part of the projecting skirt portion, the projecting skirt portion having a largest skirt length, and an inclined skirt portion of the skirt portion, the inclined skirt portion adjoining the projecting skirt portion at one end thereof, and having a skirt length which decreases in a direction away from the largest skirt length of the projecting skirt portion and a short skirt portion which is adjacent to the other end of the inclined skirt portion and having skirt length which is shorter than the skirt length of the projecting skirt portion.

2. A color cathode ray tube according to claim 1, wherein the inclined skirt portion has the short length thereof decrease linearly.

3. A color cathode ray tube according to claim 1, wherein the inclined skirt portion has the skirt length thereof decrease non-linearly.

4. A color cathode ray tube according to claim 3, wherein the non-linear decrease is a curve.

5. A color cathode ray tube according to claim 1, wherein said shadow mask has a notched portion between the inclined skirt portion and the projecting skirt portion.

6. A color cathode ray tube according to claim 1, wherein the projecting skirt portion is a half-etched portion so that the projecting skirt portion is mechanically weak.

7. A color cathode ray tube including a panel portion, a neck portion, a funnel portion connecting said panel portion and said neck portion, a shadow mask structure having a skirt portion of the shadow mask welded to a frame, said shadow mask having at least one of a longer side skirt portion and a shorter side skirt portion, and an electron gun housed in the neck portion which emits a plurality of electron beams, wherein said shadow mask includes a projecting skirt portion at the longer side skirt portion and having a welding portion which welds the shadow mask to the frame, the projecting skirt portion having a largest skirt length, and an inclined skirt portion of the skirt portion, the inclined skirt portion adjoining the projecting skirt portion at one end thereof and having a skirt length which decrease in a direction away from the projecting skirt portion, a short skirt portion having one end which is adjacent to the other end of the inclined skirt portion and having a skirt length which is shorter than the skirt length of the projecting skirt portion, and a corner projecting portion is adjacent to an other end of the short skirt portion, the corner projecting portion having another welding portion for welding the shadow mask to the frame.

8. A color cathode ray tube according to claim 7, wherein the inclined skirt portion has the short length thereof decrease linearly.

9. A color cathode ray tube according to claim 7, wherein the inclined skirt portion has the skirt length thereof decrease non-linearly.

10. A color cathode ray tube according to claim 9, wherein the non-linear decrease is a curve.

11. A color cathode ray tube according to claim 7, wherein said shadow mask has a notched portion between the inclined skirt portion and the projecting skirt portion.

12. A color cathode ray tube according to claim 7, wherein the projecting skirt portion is a half-etched portion so that the projecting skirt portion is mechanically weak.

* * * * *